US008844319B2

(12) United States Patent
Weingarten

(10) Patent No.: US 8,844,319 B2
(45) Date of Patent: Sep. 30, 2014

(54) CUT GEMSTONE PROVIDING A SPECIFIC OPTICAL PATTERN

(76) Inventor: Jonathan Weingarten, Wantagh, NY (US)

( * ) Notice: Subject to any disclaimer, the term of this patent is extended or adjusted under 35 U.S.C. 154(b) by 530 days.

(21) Appl. No.: 13/006,744

(22) Filed: Jan. 14, 2011

(65) Prior Publication Data

US 2012/0180525 A1 Jul. 19, 2012

(51) Int. Cl.
*A44C 17/00* (2006.01)

(52) U.S. Cl.
CPC ..... *A44C 17/001* (2013.01)
USPC ..... 63/32; D11/89; D11/90

(58) Field of Classification Search
USPC ..... D11/89, 90; 125/30.01
See application file for complete search history.

(56) References Cited

U.S. PATENT DOCUMENTS

| | | | | |
|---|---|---|---|---|
| 809,531 | A * | 1/1906 | Schenck | 63/32 |
| 2,364,031 | A * | 11/1944 | Suderov | 63/32 |
| 3,808,836 | A * | 5/1974 | Jones | 63/32 |
| D330,873 | S * | 11/1992 | Kaplan | D11/90 |
| 6,474,102 | B1 * | 11/2002 | Buerger | 63/32 |
| 6,892,720 | B2 * | 5/2005 | Schachter et al. | 125/30.01 |
| 7,192,337 | B2 * | 3/2007 | Shuto | 451/41 |
| 7,225,641 | B2 * | 6/2007 | Kawabuchi et al. | 63/32 |
| 7,249,471 | B2 * | 7/2007 | Kawabuchi et al. | 63/33 |
| 2003/0154741 | A1 * | 8/2003 | Kawabuchi et al. | 63/32 |
| 2003/0188551 | A1 * | 10/2003 | Schachter et al. | 63/32 |
| 2004/0050097 | A1 * | 3/2004 | Eisenberg | 63/32 |
| 2004/0055333 | A1 * | 3/2004 | Smith | 63/32 |
| 2005/0166635 | A1 * | 8/2005 | Kawabuchi et al. | 63/32 |
| 2006/0026991 | A1 * | 2/2006 | Shuto | 63/32 |
| 2008/0190139 | A1 * | 8/2008 | Sato et al. | 63/32 |
| 2011/0000259 | A1 * | 1/2011 | Strnad et al. | 63/32 |
| 2011/0146350 | A1 * | 6/2011 | Vets | 63/32 |
| 2011/0239705 | A1 * | 10/2011 | Matsumura et al. | 63/32 |

OTHER PUBLICATIONS

AGS0009743001, American Gem Society Laboratories Diamond Quality Report, Jun. 6, 2008.*
American Gem Society Laboratories, Diamond Quality Report, No. AGS 0009743001, Jun. 6, 2008.
Al Gilbertson; American Cut: The First 100 Years; 2007; excerpted pages.
Third party letter, Dec. 31, 2013.
American Gem Society Laboratories Diamond Quality Report, No. AGS 0009743001, Jun. 6, 2008, with report verification, Sarin grading (undated), and measurements (undated).
Al Gilbertson, American Cut: The First 100 Years: The Evolution of The American Cut Diamond 1860-1960, Carlsbad, California, 2007, excerpted pages.

* cited by examiner

*Primary Examiner* — Emily Morgan
(74) *Attorney, Agent, or Firm* — Yuri Astvatsaturov

(57) ABSTRACT

A gemstone cut with a table facet, where the gemstone receives existing light from around the viewer and the facets on the bottom of the diamond effectively reflect the existing light back into the eyes of the beholder in such a manner as to maximize light performance, and to produce a unique and distinct look of light in the form of a flower with eight rounded pedals under the table facet which can be observed in natural ambient light.

8 Claims, 7 Drawing Sheets

CUT GEMSTONE PROVIDING A SPECIFIC OPTICAL PATTERN

FIELD OF THE INVENTION

The invention relates to gemstones, preferably diamonds, that have a cut or shape that causes light entering the gemstone to exit in a specific optical pattern. In particular the present invention relates to diamonds where the light exiting through the table facet provides a pattern in a flower type shape.

BACKGROUND OF THE INVENTION

One of the values of gemstones, is in their appearance. The appearance of the gemstone can often be enhanced by cutting the gemstone into different shapes, and polishing the surface of the gemstone. This is especially true with gemstones that at least pass some light through them, especially diamonds. Depending on the angle that the light strikes the surface and the material of the gemstone, the light can neither be reflected from the surface or pass through the surface. If the light passes into the gemstone, it passes through the gemstone until it reaches another surface. At this other surface, the light in the gemstone can either be reflected back into the gemstone or pass out of the gemstone.

It is often desirable to shape the gemstone so that the light entering one area of the gemstone is redirected by the gemstone to exit from another area. In particular it is often desirable to maximize the light exiting one area, since this gives the gemstone a brilliance or sparkle. Many different gemstone cuts are known, particularly for diamonds, to try to maximize the amount of light that exits one particular area of the gemstone.

One of the most popular cuts for a diamond is known as the "brilliant", which arranges the individual flat surfaces or facets to maximize the light passing out through the main table facet. The "brilliant" cut has a crown portion, a girdle portion and a pavilion portion. Each of these portions has a plurality of facets, especially the crown portion and pavilion portion. The arrangement of these facets is well known to a person of ordinary skill in the art of the present invention, and therefore no further description of the arrangement of facets in the "brilliant" cut is necessary or warranted.

There are many variations of the "brilliant" cut style. Very often the angle of the facets is changed slightly to account for the original shape of the rough diamond, to increase the yield from the rough diamond, or personal preferences. Sometimes the shapes of the facets are changed to provide a finish diamond with a square or rectangular shape. Even with these variations, the cuts still follow the well-known "brilliant" style.

There are many other facet designs, such as the "Old Mine Cut" and the "Old European Cut round". The arrangement of the facets in these antique designs are well known to a person of ordinary skill in the art of the present invention, and therefore no further description of the arrangement of facets in these antique facet designs is necessary or warranted.

SUMMARY OF THE INVENTION

It is an object of the present invention to provide a gemstone cut with a table facet, where the gemstone receives existing light from around the viewer and for the facets on the bottom of the diamond to effectively reflect the existing light back into the eyes of the beholder in such a manner as to maximize light performance, and to produce a unique and distinct look of light in the form of a flower type shape or pattern under the table facet which can be observed in natural ambient light. The flower-type shape or pattern having eight round shaped petals surrounding a round shaped center, somewhat like the shape of the daisy flower.

The present invention accomplishes this object in a polyhedron gemstone with a round girdle portion and a girdle plane. A crown portion extends from one side of the girdle portion, and includes a table facet with a plurality of crown facets arranged around the table facet. A pavilion portion extends from another side of the girdle portion diametrically opposite the crown portion, and includes a plurality of pavilion facets tapering the pavilion portion together as the pavilion portion extends away from the girdle. The facets are in an arrangement or a facet structure that follows that of the antique facet design, the "Old European Cut Round" or the brilliant facet style, and where the angles of the facets have been proportioned in such a manner as to provide the above described flower-type shape effect under the table facet.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
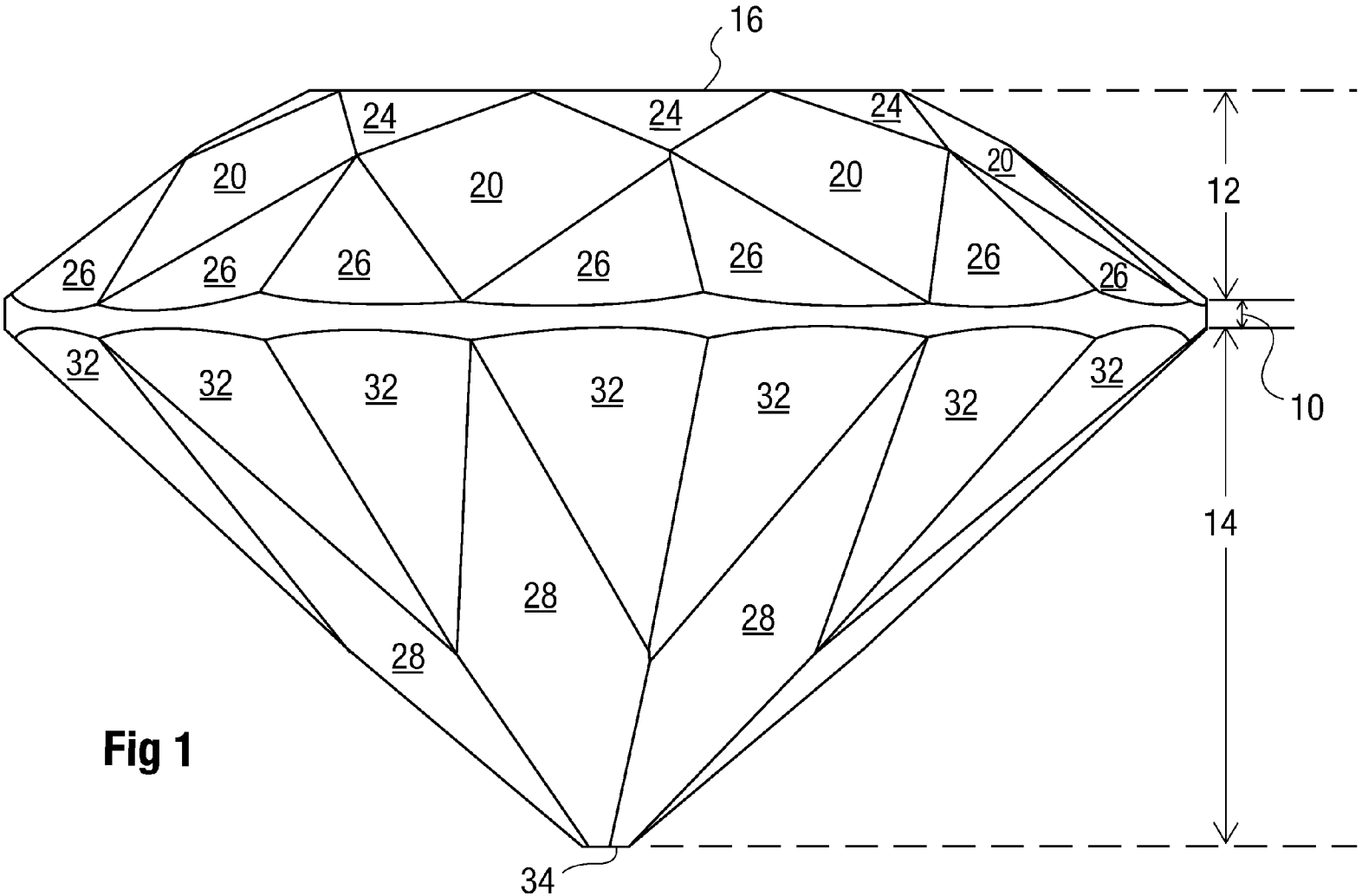
FIG. 1 is a side view of an embodiment of the gemstone cut.
Figure 2:
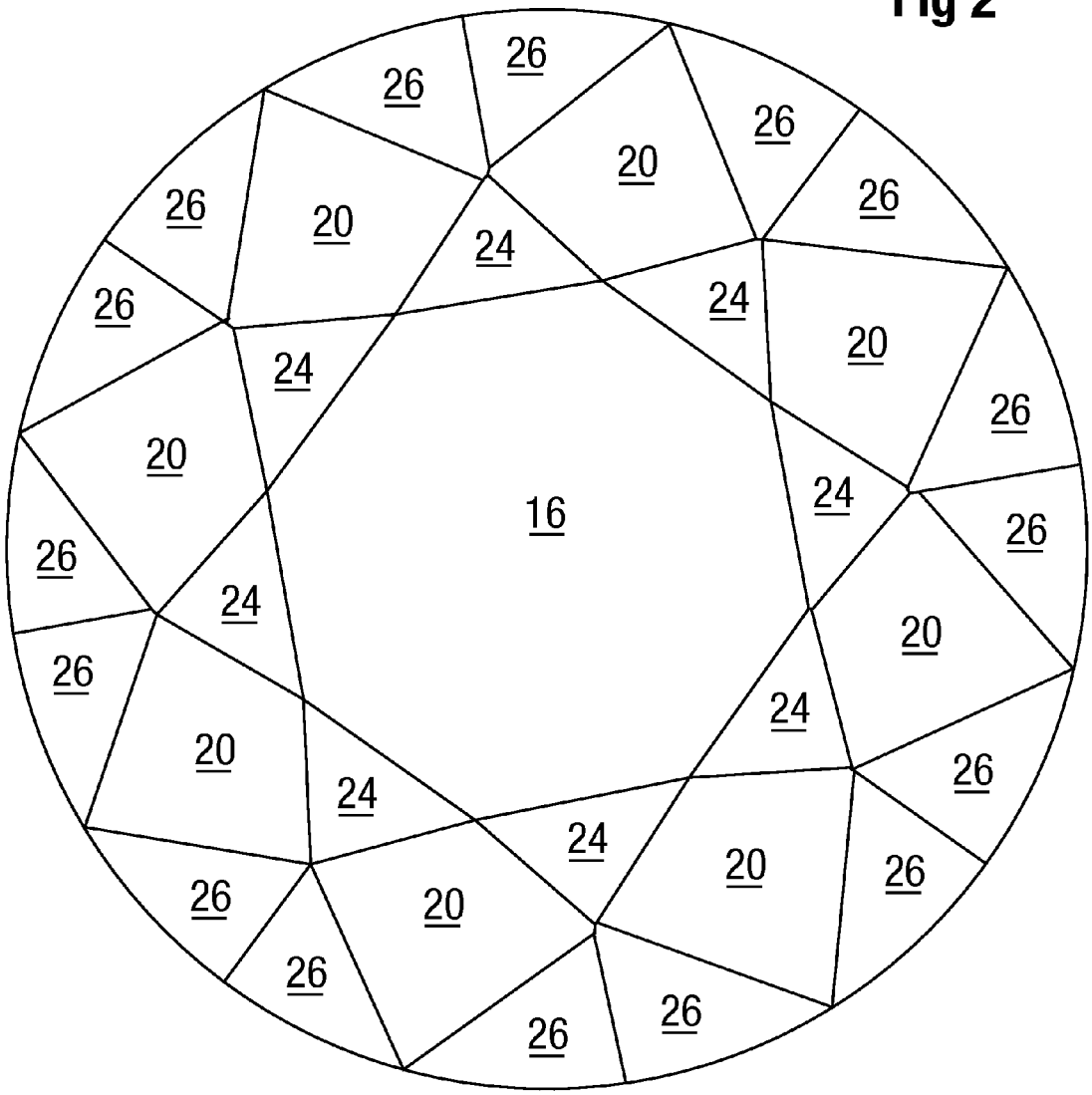
FIG. 2 is a top view of the gemstone cut.
Figure 3:
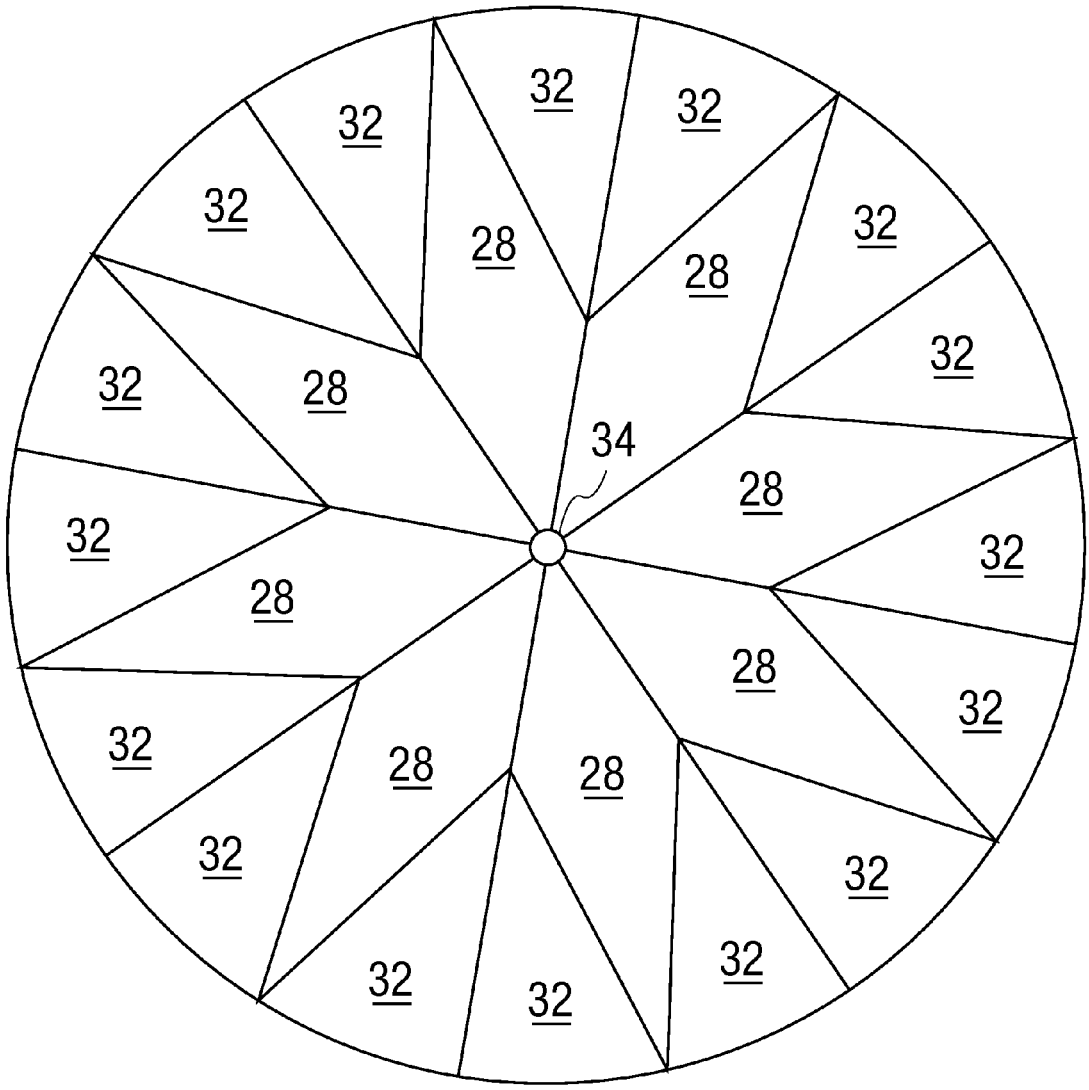
FIG. 3 is a bottom view of the gemstone cut.

Referring to the drawings in particular, FIG. 1 shows a side view of a gemstone, not necessarily drawn to scale. The gemstone has a girdle portion 10 in a round or substantially round shape. A crown portion 12 extends from one side of the girdle portion 10, and a pavilion portion 14 extends from another side of the girdle portion 10. The crown portion 12 and pavilion portion 14 are on diametrically opposite sides of the girdle portion 10. The crown portion 12 and the pavilion portion 14 have a plurality of facets. The girdle portion 10 can optionally be smooth or faceted.

The crown facets include, a table facet 16, eight crown main facets 20. The crown facets also include eight crown star facets 24 arranged between the table facet 16, and the crown main facets 20. One of these crown star facets 24 is arranged between, and is adjacent, each adjacent pair of crown main facets 20. Each crown star facet 24 is also adjacent to one edge of the table facet 16.

The crown facets also include sixteen crown half facets or crown girdle facets 26 arranged around the table facet 16 and directly adjacent to the girdle portion 10. Two of these crown half facets 26 are arranged between each adjacent pair of crown main facets 20. Each of these crown half facets 26 is also directly adjacent to a crown main facet 20. The crown portion 12 may include another facet, not shown.

The pavilion facets include eight pavilion main facets 28. The pavilion facets also include sixteen pavilion half facets or pavilion girdle facets 32 arranged around the pavilion portion 14 and directly adjacent to the girdle portion 10. Two of these pavilion half facets 32 are arranged between each adjacent pair of pavilion main facets 28. Each of these pavilion half facets 32 is also directly adjacent to a pavilion main facet 28. The pavilion portion 14 can also have a culet 34.

Figure 4:
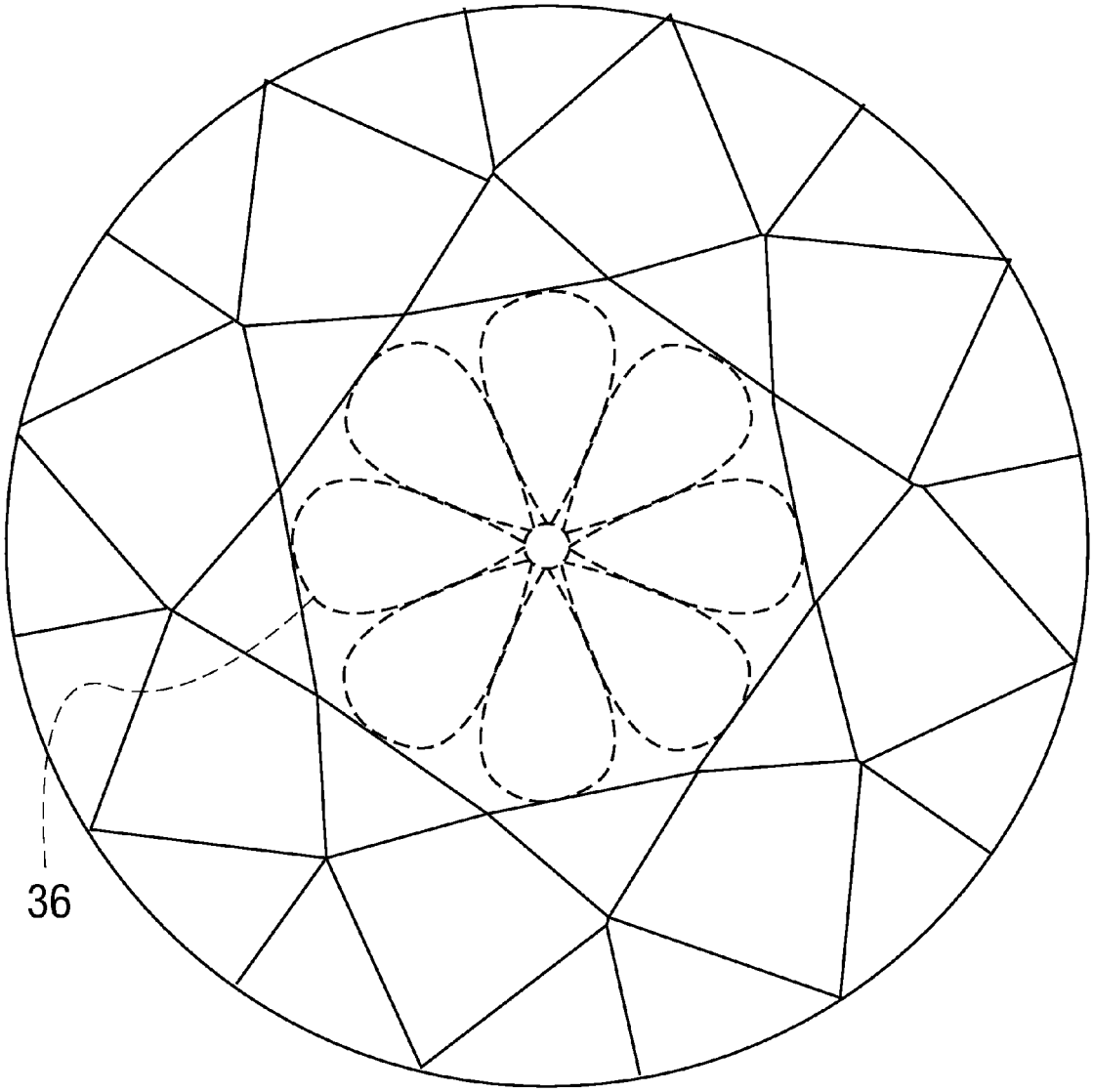
FIG. 4 is a top view of the gemstone cut showing the rounded flower pedal pattern in a schematic view.

In order to produce the optical pattern of the eight pedal flower 36, as shown in FIG. 4, under the table facet 16, the crown and pavilion facets are arranged in specific angular ranges with respect to a plane of the girdle portion 10. These angles depend on the refractive index of the gemstone. For a diamond gemstone, the facets would be preferably arranged in the following ranges:

| | | |
|---|---|---|
| crown main facets 20 | 35-36 | degrees |
| crown star facets 24 | 22-25 | degrees |
| crown half facets 26 | 38-42 | degrees |
| pavilion main facets 28 | 41-41.6 | degrees |
| pavilion half facets 32 | 42.7-44 | degrees and cut to 60-65% of the pavilion depth. |

To further produce the optical pattern of an eight pedal flower 36, it is preferable for the table facet to be 47-51% of the average diameter of the diamond, the lower half facet length to be 60%+/−5% with respect to length from the edge of the girdle to the cullet, and the star facet/upper half facet ratio to be 40% (+/−5%) with respect to table edge-to-girdle length. A culet can be present or not.

The pavilion facets on the bottom of a diamond will function as either mirrors (reflectors of light, good) or windows (leakers of light, bad). An important step in the optical design is ensuring that the pavilion (bottom facets) are effectively reflecting light back to the viewer. Another important step in the optical design is ensuring that the crown of the diamond draws in its reflections from the brightest resources in the environment. The present invention is designed for the majority of its reflections from the 45-75° angular spectrum.

Figure 5:
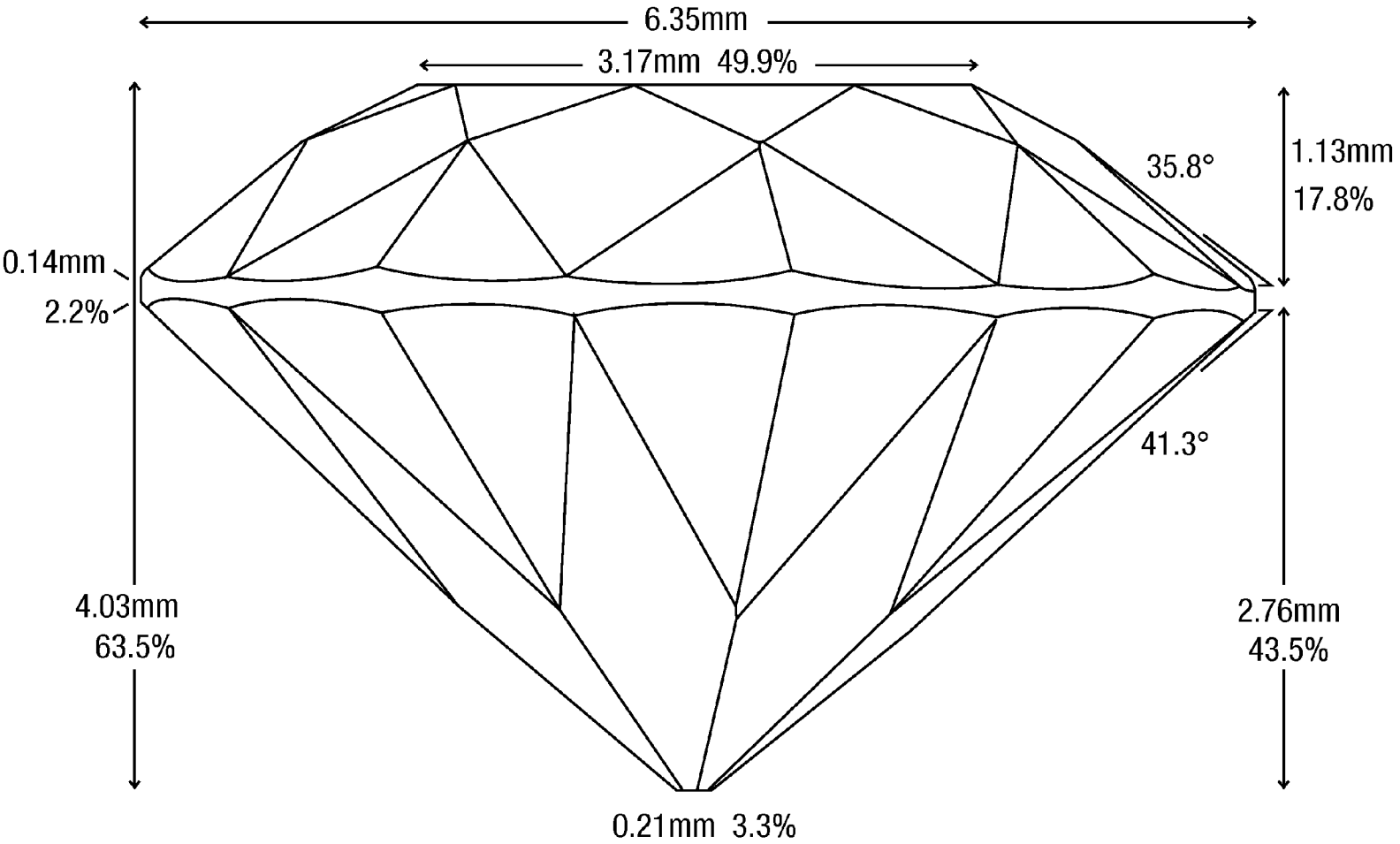
FIG. 5 is a side view of one embodiment of the present invention.
Figure 6:
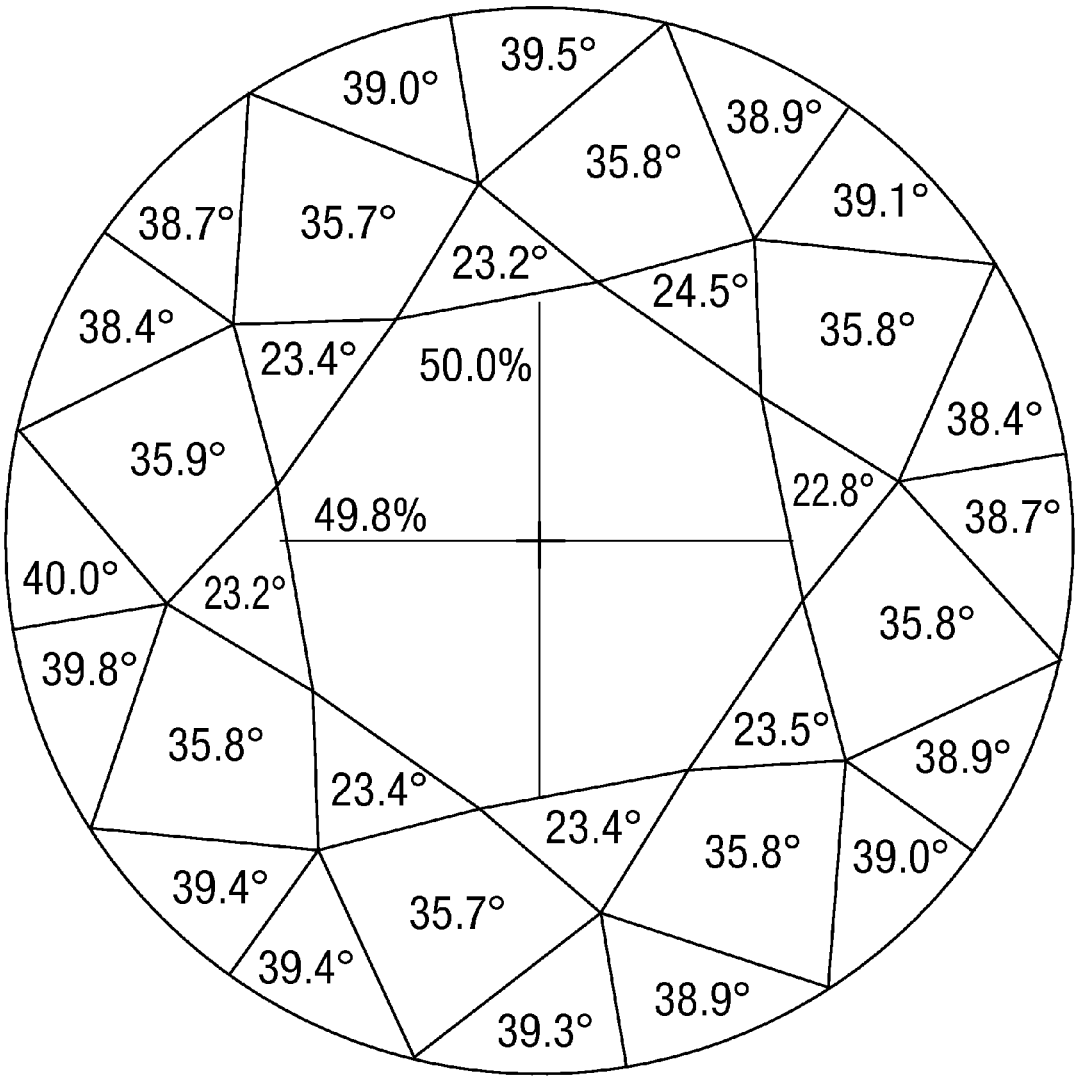
FIG. 6 is a top view of the embodiment of FIG. 5.
Figure 7:
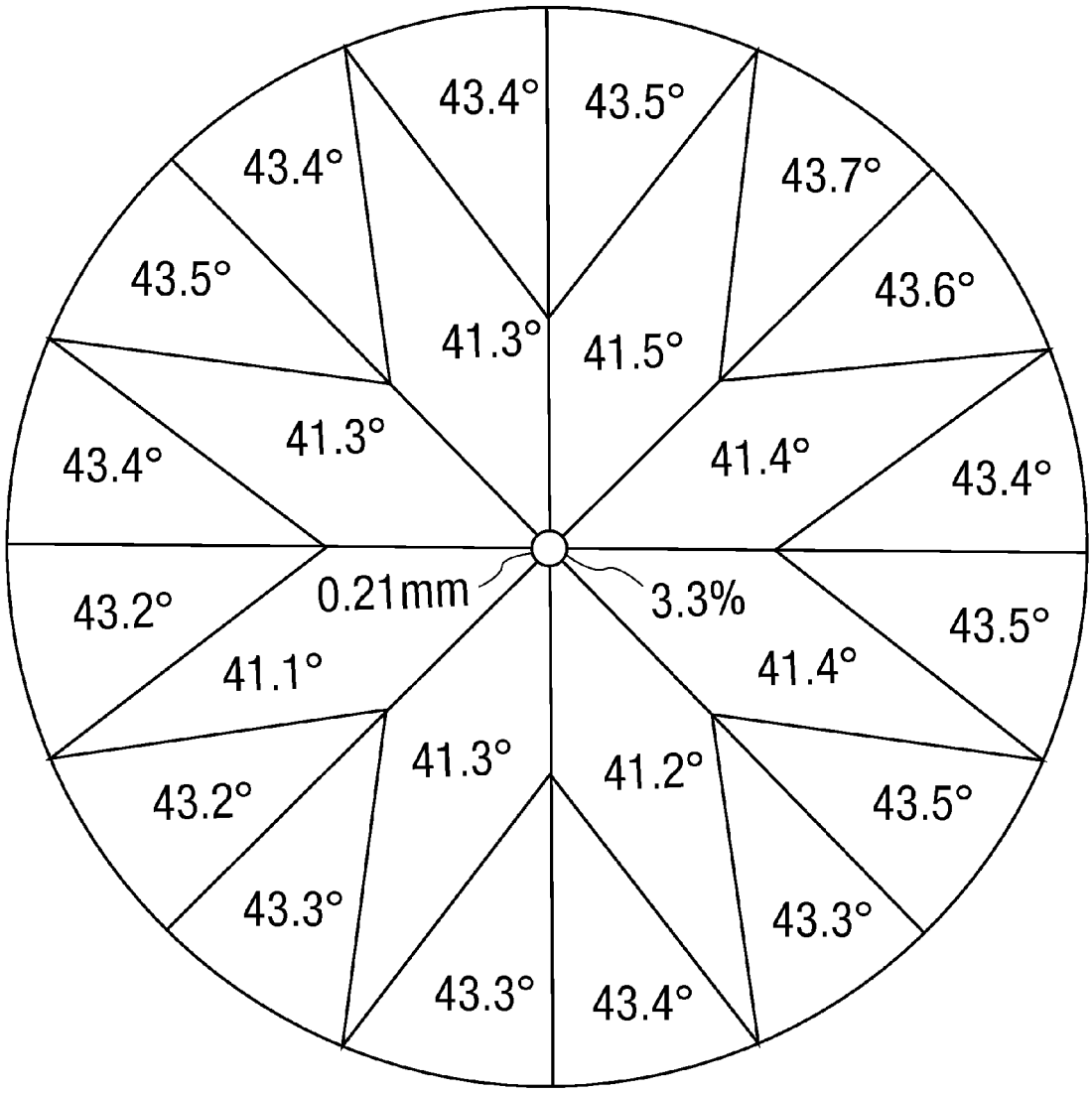
FIG. 7 is a bottom view of the embodiment of FIG. 5.

One of the preferred embodiments of the gemstone in diamond are shown in FIGS. 5, 6 and 7. In FIGS. 6 and 7, the slope angles are shown for each facet. The dimensions of the table facet, crown, pavilion and the culet are also shown. All of the facets in each type of facet can either have the same slope angle, or a slightly different slope angle as shown in the drawings.

The gemstone cut shape of the present invention is not limited to only the above described facets. Additional facets can be included, especially to complete an enclosed volume.

While specific embodiments of the invention have been shown and described in detail to illustrate the application of the principles of the invention, it will be understood that the invention may be embodied otherwise without departing from such principles.

What is claimed is:

1. A cut diamond providing an optical pattern of an eight petal flower appearing in the diamond when viewed above a table facet, comprising:

a girdle portion having a girdle plane, said girdle portion having a substantially round shape;

a crown portion on one side of said girdle portion, said crown portion including:

a table facet having eight sides, said table facet having an octagonal shape, eight crown star facets arranged around said table facet, each one of said eight crown star facets arranged adjacent to one of said eight sides of said table and arranged at an angle between 22-25 degrees with respect to said girdle plane, eight crown main facets arranged around said table facet, each one of said eight crown main facets arranged adjacent to two of said eight crown star facets and arranged at an angle between 35-36 degrees with respect to said girdle plane, and sixteen crown half facets arranged around said table facet, each one of said sixteen crown half facets arranged adjacent to said girdle portion, to one of said eight crown main facets, and to one other of said sixteen crown half facets, each one of said sixteen crown half facets arranged at an angle between 38-42 degrees with respect to said girdle plane; and a pavilion portion arranged on another side of said girdle portion diametrically opposite said crown portion, said pavilion portion tapering inward towards a point as it extends away from said girdle plane, said pavilion portion including:

sixteen pavilion half facets, each one of said sixteen pavilion half facets arranged adjacent to said girdle portion and to one other of said sixteen pavilion half facets, each of said sixteen pavilion half facets arranged at an angle between 42.7-44 degrees with respect to said girdle plane; and eight pavilion main facets, each one of said eight pavilion main facets arranged adjacent to two of said sixteen pavilion half facets and to two other of said eight pavilion main facets, each one of said eight pavilion main facets arranged at an angle between 41-41.6 degrees with respect to said girdle plane wherein, when said cut diamond is viewed from above, a majority of said cut diamond reflects incident light impinging on said cut diamond at an angle between 45 and 75 degrees with respect to said girdle plane, and wherein for each of said sixteen crown half facets, said incident light impinging on said cut diamond at said angle between 45 and 75 degrees with respect to said girdle plane is reflected through about 81% to about 99% of a surface area of said respective crown half facet, said respective surface area being determined when said cut diamond is viewed from above.

2. The cut diamond cut shape of claim 1, wherein:

said girdle portion has a horizontal width, and said table facet has a width that is 47-51% of said width of said girdle portion.

3. The cut diamond cut shape of claim 1, wherein said crown portion further comprises eight table edge-to-girdle lengths, each of said eight table edge-to-girdle lengths extending from one of said eight sides of said table facet to said girdle portion, each of said eight table edge-to-girdle lengths including a crown star facet portion and a crown half facet portion, the ratio of said crown star facet portion to said crown half facet portion being between 35-45%.

4. The cut diamond cut shape of claim 1, wherein each of said sixteen pavilion half facets includes a length that is between 55-65% of a length extending from said girdle portion to said point.

5. The cut diamond cut shape of claim 1, wherein said pavilion portion further includes a culet.

6. The cut diamond cut shape of claim 5, wherein said culet is substantially parallel to said girdle plane.

7. The cut diamond cut shape of claim 1, wherein said girdle portion is at least one of faceted and smooth.

8. The cut diamond cut shape of claim 1, wherein said table facet is substantially parallel to said girdle plane.

* * * * *